United States Patent [19]

Wanamaker

[11] Patent Number: 4,892,155

[45] Date of Patent: Jan. 9, 1990

[54] LEVELING ATTACHMENT FOR A SKID-STEER VEHICLE

[76] Inventor: Richard B. Wanamaker, Rte. 1, Box 1 Parkview, Fort Stockton, Tex. 79735

[21] Appl. No.: 175,830

[22] Filed: Aug. 7, 1980

Related U.S. Application Data

[63] Continuation of Ser. No. 967,057, Dec. 6, 1978, abandoned.

[51] Int. Cl.[4] ..... A01B 35/18; A01B 59/048

[52] U.S. Cl. ..... 172/199; 172/817; 172/272

[58] Field of Search ..... 172/197, 445.1, 684.5, 172/199, 149, 150, 179, 200, 272, 817, 832, 273

[56] References Cited

U.S. PATENT DOCUMENTS

| | | | |
|---|---|---|---|
| 2,477,710 | 8/1949 | Worstell | 172/99 |
| 2,721,508 | 10/1955 | Edman | 172/9 |
| 3,233,350 | 2/1966 | Malzahn et al. | 172/272 |
| 3,237,795 | 3/1966 | Kromer | 172/272 |
| 3,448,814 | 6/1969 | Bentley | 172/146 |
| 3,470,964 | 10/1969 | West | 172/197 |
| 3,724,557 | 4/1973 | Boschung | 172/780 |
| 3,876,013 | 4/1975 | Dunn | 172/170 |
| 3,891,035 | 6/1975 | Miller et al. | 172/197 |
| 4,030,624 | 6/1977 | Matthews | 172/272 X |
| 4,098,344 | 7/1978 | Johnson | 172/199 |
| 4,109,731 | 8/1978 | Van der Lely | 172/68 |
| 4,299,290 | 11/1981 | Nunes, Jr. | 172/445.1 |

FOREIGN PATENT DOCUMENTS

| | | | |
|---|---|---|---|
| 954309 | 9/1974 | Canada | 172/177 |

OTHER PUBLICATIONS

5-N-1 Lawn Finisher Brochure; revised 09/78; Central Tool Co., Inc.

*Tractors and Their Power Units*; 2nd Ed., 1963; Barger et al.; Wiley & Sons.

*Primary Examiner*—Richard J. Johnson
*Assistant Examiner*—Jeffrey L. Thompson
*Attorney, Agent, or Firm*—Hugh H. Drake

[57] ABSTRACT

An earth working apparatus features a horizontally-oriented rigid support frame across a forward end of which is disposed a generally vertical scraper blade. Mounted forwardly of the frame is a roller. A holding device projects rearwardly from the frame and is pivotally coupled to a steerable motive vehicle in a manner which permits vertical swinging of the frame. A ram is disposed vertically above the holder. The ram is pivotally coupled at one end to the support frame and at the other end to the vehicle so as to effect swinging of the frame. Also pivotally mounted on the vehicle to swing vertically is an elevator linkage. The holder is pivotally coupled to a swinging end of that linkage and the ram is pivotally coupled thereto. Also mounted laterally across the support frame and forwardly of the scraper blade is a drag blade.

7 Claims, 5 Drawing Sheets

LEVELING ATTACHMENT FOR A SKID-STEER VEHICLE

RELATED APPLICATION

This application is a continuation of application Ser. No. 967,057, filed Dec. 6, 1978, now abandoned, by the same inventor.

The present invention pertains to earth working apparatus. More particularly, it relates to a combination of a vehicle and a scraper.

The so-called box scraper is well known. It usually takes the form of a rectangular frame laterally across which, or forming one end of which, is a downwardly depending scraper blade. The frame is towed or pushed across the surface of a field of dirt and operates in a manner which tends to leave a smoothed-out path.

It also has been known to mount a roller behind a scraper blade. The roller serves to smooth scraped dirt so as to further distribute and compact the dirt which has been disturbed by the scraper blade. In use, the combined scraper and roller assembly are dragged over the surface of the ground.

Entirely different machines normally are utilized for shaping sloping surfaces such as those of a hill or ditch. The bulldozer is a familiar example. Drag buckets are another. Of course, a bulldozer, with a simple pusher blade, also can be used to achieve a rough level of a flat plane. Normally, however, the result achieved by the use of a bulldozer is too crude to prepare land suitably for the efficient application of paving or for the installation of sod so as to result in an attractive level lawn area.

By following bulldozer operation with treatment by a box scraper such as mentioned above, a reasonably-level surface ultimately can be obtained. However, two separate machines are necessitated, because the box scraper cannot in itself achieve more than a minor amount of contouring of the surface. Moreover, the conventional box scraper is rather useless, or at least extremely awkward to use, in connection with the contouring of either upward or downward slopes of any significant degree of inclination.

It is a general object of the present invention to provide a new and improved earth moving apparatus fully capable in ordinary usage of attaining the combined results of separate machines such as those described above.

Another object of the present invention is to provide an improved earth working apparatus which readily enables both contouring and smoothing;

A further object of the present invention is to provide a new and improved earth working apparatus that has equal facility in use for leveling and smoothing both level surfaces and significantly sloping surfaces.

Earth working apparatus constructed in accordance with the present invention includes a nominally horizontally-oriented rigid support frame. A generally vertically-oriented scraper blade is mounted laterally across the forward end of that frame. A roller is mounted from and forwardly of the frame. The overall combination includes a steerable motive vehicle. Holding means project rearwardly from the support frame in pivotally coupled relationship to the vehicle for enabling vertical swinging of the support frame. Finally, ram means, disposed vertically above the holding means, is pivotally coupled at one end to the support frame and at the other end to the vehicle so as to effect swinging of the support frame.

The features of the present invention which are believed to be patentable are set forth with particularity in the appended claims.

The organization and manner of operation of the invention, together with further objects and advantages thereof, may best be understood by reference to the following description taken in connection with the accompanying drawings, in the several figures of which like reference numerals identify like elements, and in which.

Figure 1:
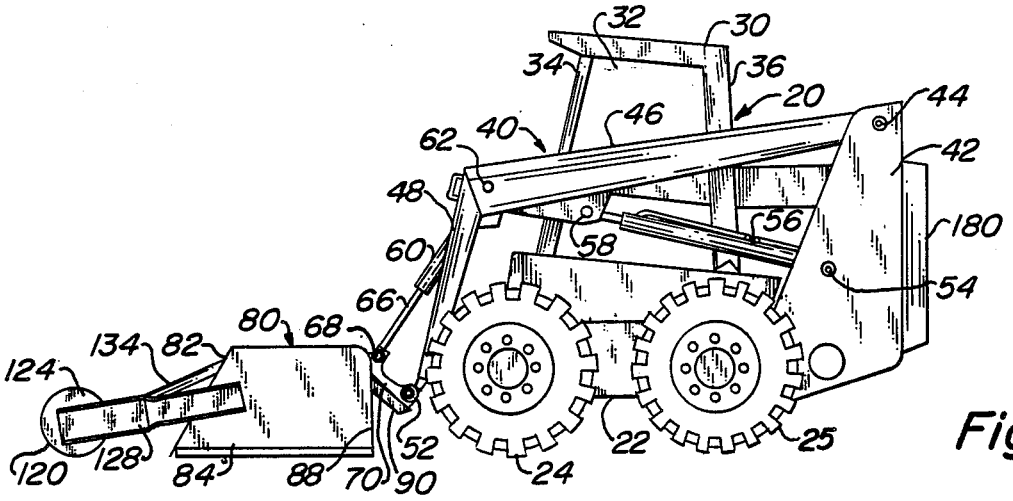
FIG. 1 is a side-elevational view of one embodiment of earth working apparatus.
Figure 2:
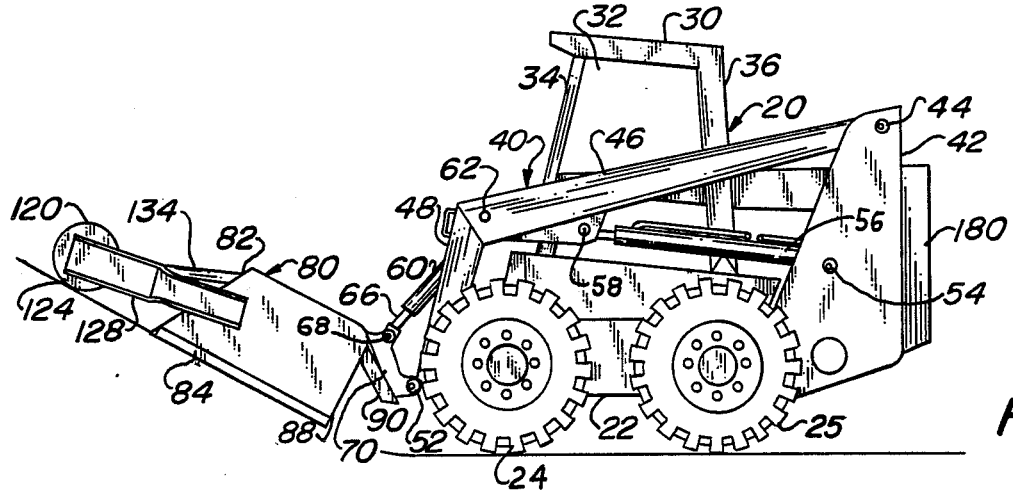
FIG. 2 is a view similar to FIG. 1 but with certain of the components in a different position.
Figure 3:
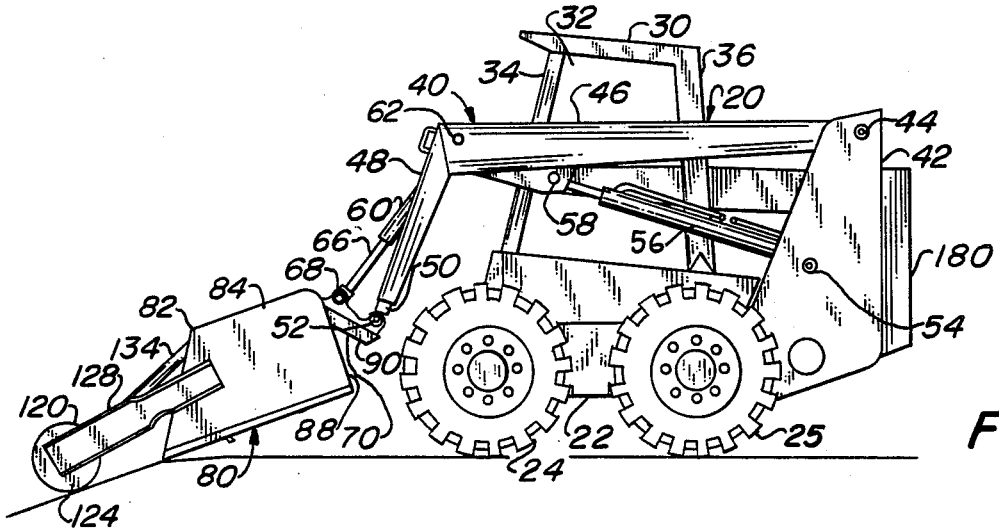
Figure 4:
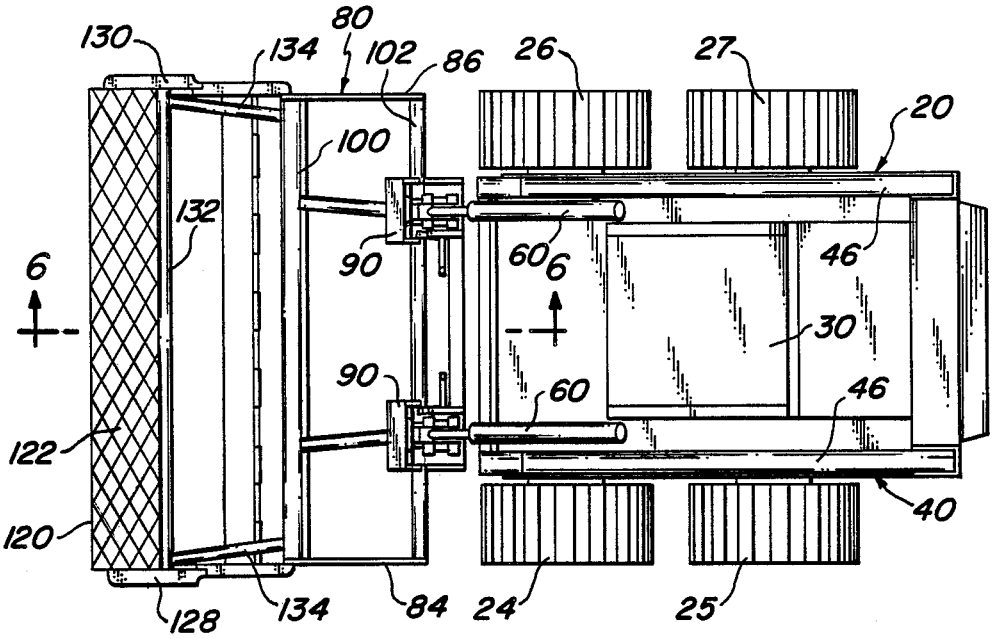
Figure 5:
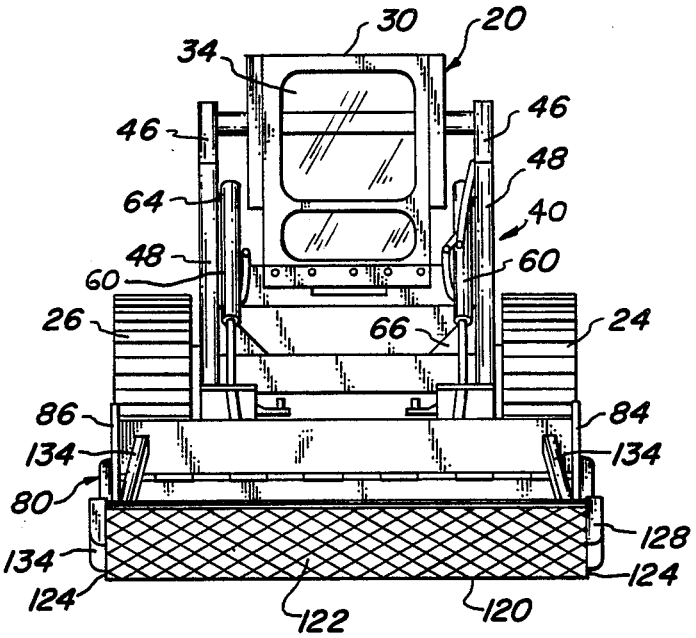
Figure 6:
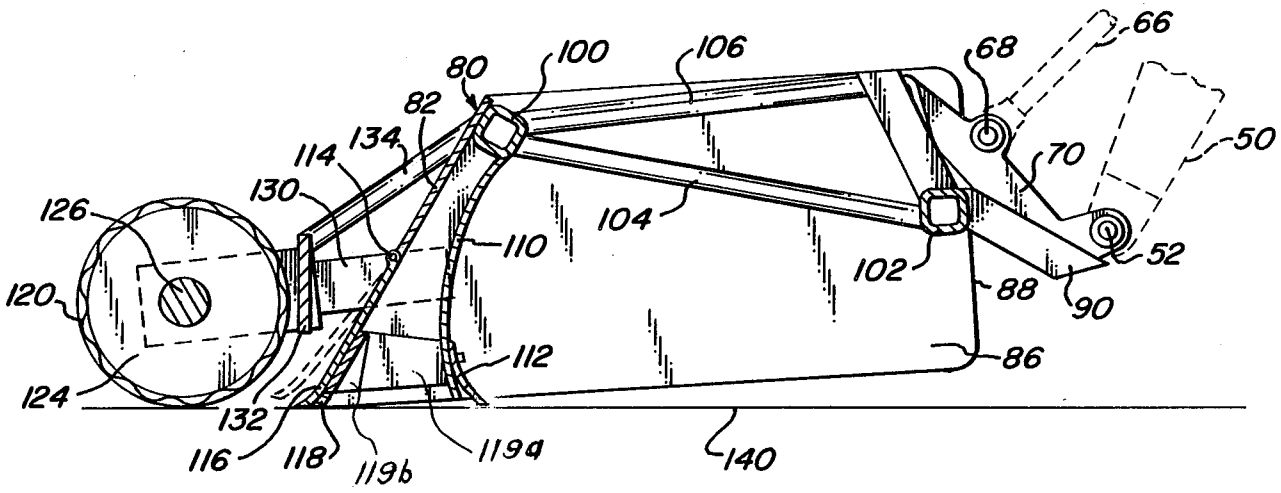
Figure 7:
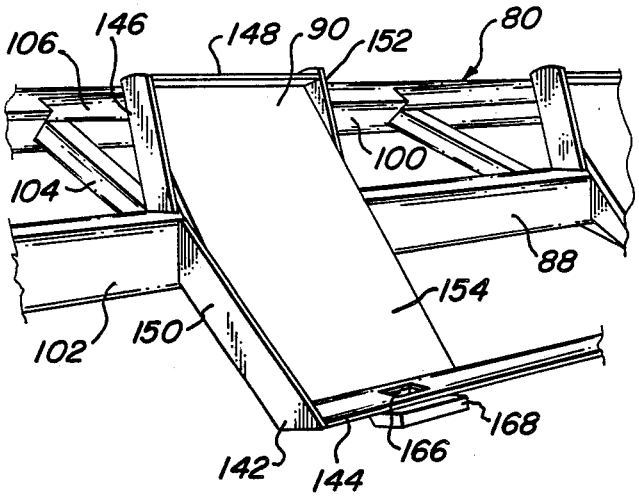
Figure 8:
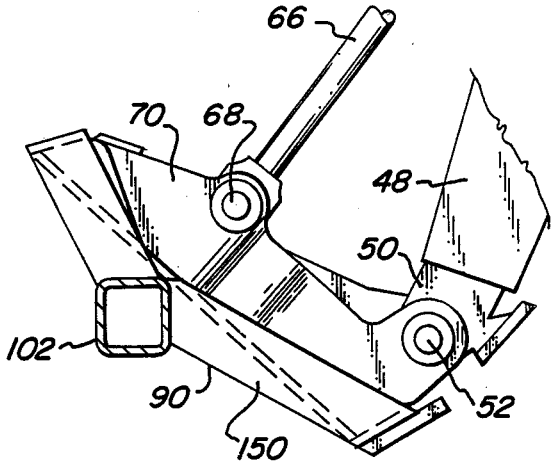
Figure 9:
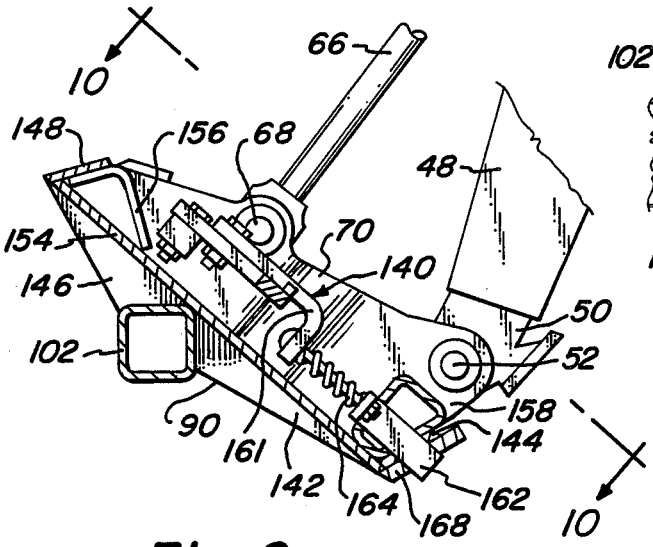
Figure 10:
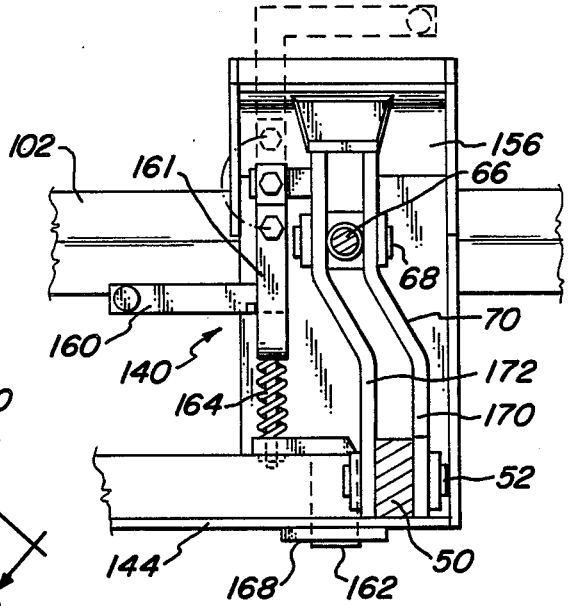
Figure 11:
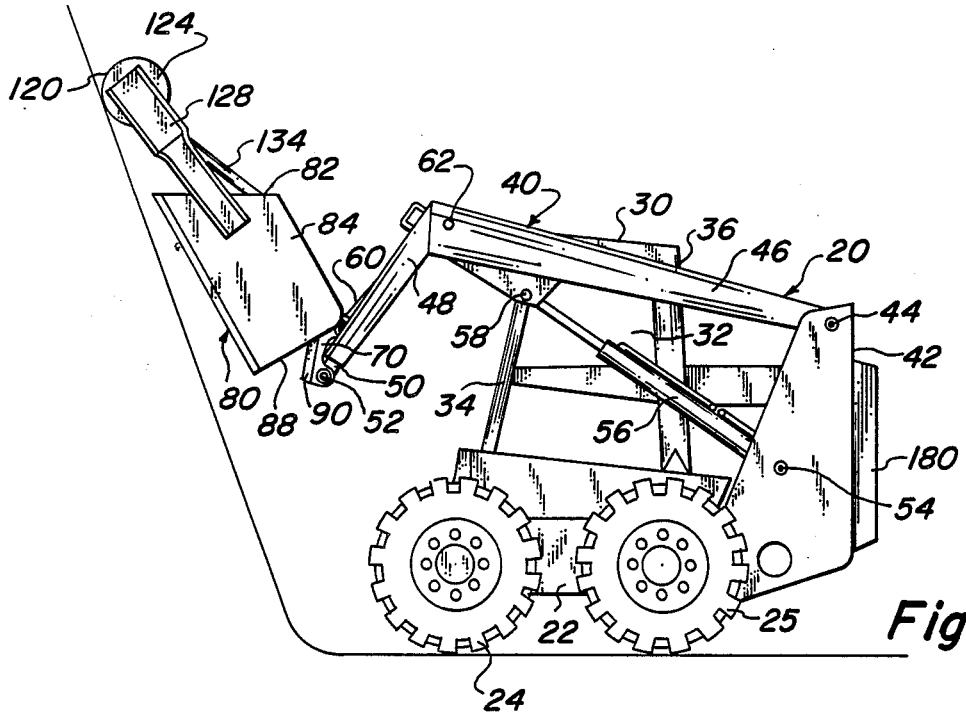
Figure 12:
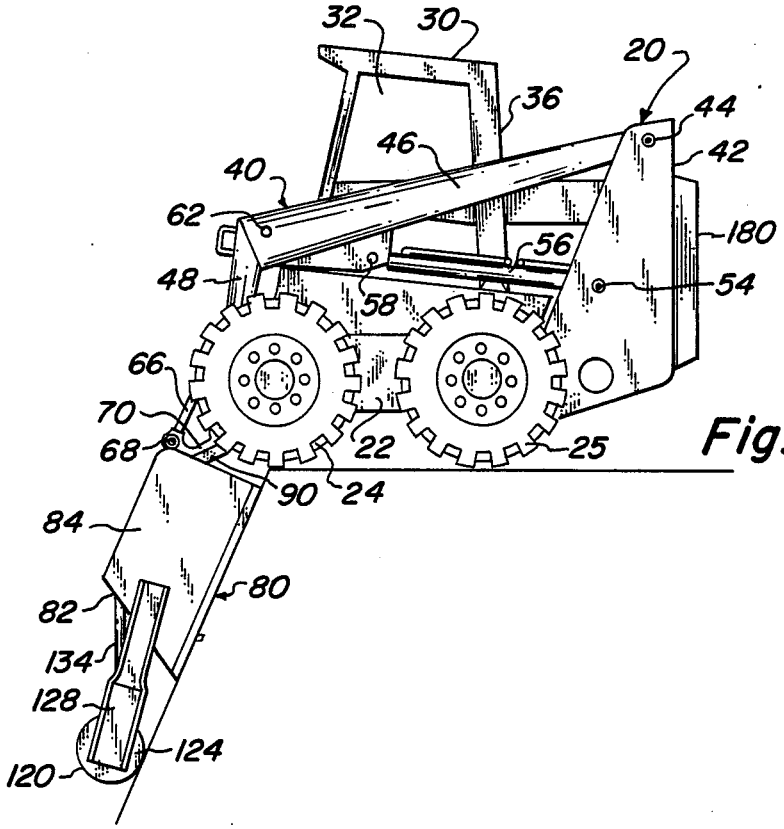

FIG. 3 also is a view similar to FIG. 1 but with those certain components in a still different position;

FIG. 4 is a top plan view of the apparatus of FIG. 1;

FIG. 5 is a front elevational view of the apparatus shown in FIG. 1;

FIG. 6 is a fragmentary cross-sectional view taken along the line 6—6 in FIG. 4;

FIG. 7 is a fragmentary and enlarged perspective view of a portion of the apparatus shown in the earlier figures;

FIG. 8 is a fragmentary and enlarged side-elevational view of a removable coupling shown more generally in FIGS. 1–6;

FIG. 9 is a broken-away cross-sectional view of the coupling shown in FIG. 8;

FIG. 10 is a fragmentary plan view of a portion of a locking mechanism included within the coupling of FIGS. 8 and 9; and FIGS. 11 and 12 are side-elevational views similar to FIGS. 2 and 3, respectively, but with certain components still differently positioned to achieve correspondingly greater angles of operation relative to the horizontal.

A steerable motive vehicle 20 has a main frame or chassis 22 carried by four conventionally-disposed tire-mounted wheels 24, 25, 26 and 27 located at conventional positions for a wheeled vehicle. Projecting upwardly from the central portion of vehicle or tractor 20 is a cab 30 for enveloping the space occupied by the operator of the tractor. Cab 30 includes side windows 32 and a front window 34 suitably supported to enable operational vision by the operator located within cab 30. Similarly, a rear window 36 also is included to enable that operator better to observe rearward movement of tractor 20.

Mounted toward the rear within chassis 22 is an internal combustion engine of a conventional nature and in this case powered by a fuel such as gasoline or diesel. In any case, the motive drive source preferably is coupled through well-known transmissions and differentials so as to drive wheels 24–27 in what is known as a skid-steer mode of operation. That is, none of the wheels are coupled to the vehicle so as, in themselves, to be capable of turning relative thereto. Instead, controls are provided to the operator within cab 30 so as to enable selective energization or braking of each individual wheel as desired. As is well known, such a degree of control enables the vehicle to be turned about a very short radius relative to the central vertical axis of the vehicle itself. That allows the user to have significant flexibility of manipulation of the front of the vehicle relative to any external object or surface.

The motive drive source within tractor 22 also powers the actuation of various rams in the form of cylinders within which pistons move under the application of hydraulic pressure and which are connected to external rods capable of extending or retracting so as to move coupled elements. Alternatively, of course, other linear actuators could be substituted. As shown, a framework 40 includes a standard 42 which projects upwardly from the rear end portion of chassis 22. Projecting forwardly from a pivotal coupling 44 at the upper end of standard 42 is a forwardly-extending elevator arm 46 from the forward end of which a leg 48 rigidly projects downwardly and slants generally forwardly of vehicle 22. Telescoped within and adjustable in steps with respect to leg 48 in a mutually longitudinal direction is a hoist link 50 to the lower end of which is rigidly affixed a pivotal coupling 52.

Mounted on standard 42 and spaced well below pivot 44 is another pivotable coupling 54 which is suitably joined to one end of a hydraulic ram 56 so as to allow swinging movement of the latter. The remote end of ram 56, as represented in this case by its outward piston end, is pivotally coupled as at 58 to the underside of the forward end of arm 46 near its junction with leg 48. As is clearly evident from an examination of FIGS. 1–3, the actuation of ram 56 serves to swing arm 46, and thus also leg 48, in a direction to move pivotal coupling 52 generally in a vertical direction. Of course, that movement is along an arc about pivot 44 and the arc diameter is dependent upon the telescopic extension of link 50 with respect to leg 48.

Another ram 60 is pivotally coupled at one end in alignment with a point 62 (and as at 64) on the inner side of the forward end portion of arm 46 so as to lie generally alongside the inner surface of leg 48. Projecting generally downward from ram 60 is its piston 66 the outer end of which terminates in a pivotable coupling 68.

Pivotal couplings 52 and 68 are rigidly mounted to spaced portions of a foot pad 70. Coupling 68 is disposed at a nominally higher elevation than coupling 52.

Individual controls for contraction and extension of rams 56 and 60 are located within cab 30 to regulate the flow of power from a hydraulic pump mounted within chassis 22 and driven by the engine of tractor 20. That is, rams 56 and 60 are subject to individually independent hydraulic control.

Situated in front of tractor 20 is a box scraper 80. Scraper 80 includes a front wall 82, space-opposed side walls 84 and 86 and a rear wall 88. Rigidly affixed and built into rear wall 88 is a shoe 90 into which foot pad 70 is detachably affixed in rigid relationship. Thus, the rigid support frame formed by the walls of box scraper 80 is mounted from and carried by tractor 22 when foot pad 70 is coupled into shoe 90.

As thus far described, reference has been made only to a single one of arm 46, leg 48, rams 56 and 60 and foot pad 70 together with shoe 90. Conceptually, only one such linkage and coupling system is needed as between box scraper 80 and tractor 20. For strength and balance, however, a plurality of such linkage and coupling arrangements preferably is employed, with one such arrangement being mounted on either side of cab 30 as illustrated in FIGS. 4 and 5. As embodied, these two linkage and coupling arrangements are identical. Thus, a pair of shoes 90 are spaced apart along rear wall 88 of box scraper 80 for cooperation with the respective ones of the dual linkages and couplings.

Moreover, the preferred form of tractor 20, complete with the elevator linkage including arm 46 and leg 48, rams 56 and 60 and all of their associated controls is in itself available in the commercial marketplace under the designation of "Melroe Bobcat". This particular tractor and hydraulic assemblage is, however, only a preferred portion of the overall combination under description. Alternative tractors together with associated linkages and couplings may be utilized either as purchased in the market or built especially for the purpose at hand.

As shown primarily in FIG. 6, box scraper 80 is formed into a rigid support frame by means of upper forward and rear cross members 100 and 102 which are secured between side walls 84 and 86. Front wall 82 depends downwardly and forwardly from member 100. Shoes 90, in this case, are formed right into member 102 as part of what constitutes the rear "wall" 88 which, as such, needs not include any further components. A longitudinal strut 104 is secured between members 100 and 102 in longitudinal alignment with each of shoes 90. Similarly located struts 106 extend between cross member 100 and the upper end portion of each of shoes 90.

Secured rigidly between side walls 84 and 86 and depending downwardly from cross member 100 is a scraper blade 110. While the lower margin of blade 110 may serve directly as an actual cutting edge, the preferred embodiment as illustrated includes a separate cutting element 112 mounted along the lower margin of blade 110 and removable for purposes of repair, sharpening or replacement. The provision of such a removable cutting edge on a blade is, of course, conventional in analogous apparatus.

Front wall 82 depends downwardly from cross member 100 only a portion of the height of blade 110. Hinged at 114 along the lower margin of front wall 82 is a drag blade 116 which completes the remainder of front wall 82 and is free to swing forwardly at its bottom margin away from blade 110. Preferably, the bottom marginal portion of drag blade 116 curves slightly forwardly as indicated in FIG. 6 and has a highly-tempered steel bar 118 or the like secured along the edge of that bottom marginal portion which faces scraper blade 110. Several laterally-spaced girders 119*a* project rigidly forward from blade 110 to a cross member 119*b* which serves to limit downward swinging of blade 116 to a position in alignment with the forward margins of side walls 84 and 86. Rigidly spaced in front of box scraper 80 is a roller 120. Roller 120 preferably presents an exterior surface formed by a cylinder of wire mesh 122 that features openings (e.g., one inch nominal diameter) formed into a rigid lattice of one-quarter inch steel material or the like. Mesh 122 is supported by a series of discs 124 distributed along an axle 126.

The space-opposed ends of axle 126 are journaled for rotation into the end portions of respective brackets 128 and 130 that project forwardly and slightly downwardly from the side walls of box scraper 80 when the latter is in a horizontal orientation. For additional strength, a girder 132 is secured between brackets 128 and 130, and struts 134 are rigidly secured in place between the respective outer end portions of girder 132 and the upper and forward marginal portions of side walls 84 and 86 at cross member 100.

While the operation of the unit has yet to be described, it is believed significant to note at this point that superior performance has been found to result from a careful correspondence of various dimensional relationships. In a working example, the width of box scraper 59 and roller 120 was eighty-seven inches. The overall distance from drag blade 116 to rear wall 88 was approximately forty-eight inches. The distance from the lower cutting margin of element 112 of scraper blade 110 to rear wall 88 was approximately thirty-three inches. The height of side walls 84 and 86 was twenty-seven inches. Roller 120 had an external diameter of sixteen inches and the overall lengths of brackets 128 and 130 was forty-one inches. Best results were obtained when the rearward ends of brackets 128 and 130 were respectively secured to side walls 84 and 86 at a point above the horizontal so that those brackets tilted downwardly forward as shown. With the lower cutting margin of element 112 projecting beneath the lower margin of side walls 84 and 86 by an amount of one inch, the components were rigidly interrelated so that, with bar 118 swung downwardly to its limit of movement and resting on a flat surface 136 along with the cutting edge of element 112, the lowermost portion of roller 120 was spaced above that surface by one-half inch, and the rear lower corner of the side walls was raised above the horizontal by an amount of one and one-half inches. In that construction, the base of shoes 90 defined an angle of fifty-two degrees with respect to the lower margin of side walls 84 and 86. The distance from the upper forward corner of each of the side walls to the rear upper corner was approximately thirty-two inches.

Turning particularly to FIGS. 7–10, an overcenter toggle arrangement 140 is used to captivate foot pad 70 within shoe 90. Shoe 90 is formed to have a downwardly and rearwardly depending base portion 142 from the lower end of which a bottom lip 144 projects rearwardly. An upper seating portion 146 projects upwardly and slightly forwardly from the upper margin of base portion 142. A rearwardly projecting lip 148 integrally projects from the uppermost margin of portion 146. Sidewalls 150 and 152 join all these portions. Shoe 90 includes a base plate 154 that is planar in conformation and extends from the inner margin of bottom portion 144 to the inner margin of top wall 148. Foot pad 70 fits with its sole flat against base plate 154, as its generally upward toe 156 is captivated beneath upper wall 148 and its heel 158 rests on bottom wall 144.

Overcenter linkage 140 has a bent arm 160 pivoted at its left end in FIG. 10 inside of which pivot point is pivotally coupled: one end of a bracket 161 affixed to a plunger 162 loaded by a spring 164. The lower end of plunger 162 is receivable within an aperture 166 cut through bottom wall 144 and a rigidly-affixed re-enforcing plate 168. With foot pad 70 seated into shoe 90, actuation of toggle linkage 140 to the position shown in FIG. 10 enables the lower end of plunger 162 to be disengaged from within aperture 166 and thus unlock foot pad 70 from shoe 90. For locking of foot pad 70 in shoe 90, arm 160 is swung counterclockwise to force plunger 162 into aperture 166. As will be observed, toe 156 actually is a length of angle iron shaped to fit appropriately under top wall 148 and secured to elongated bars 170 and 172 between which the journals of pivotal couplings 52 and 68 are affixed.

It will thus be seen that box scraper 80 includes a rigid support frame from which scraper blade 110 is supported in a generally vertical orientation. Tractor 20 is utilized to propel scraper 80 through pivotal coupling 52 which projects rearwardly from the frame of the scraper and permits vertical swinging of that frame about such coupling. Ram 60, which is disposed vertically above pivotal coupling 52, is in itself pivotally coupled at one end to the support frame of scraper 80 and at its other end to tractor 20 by way of elevator arm 46; ram 60 serves to enable a swinging of the entire scraper frame. Basically, pivotal coupling 52 serves to hold the scraper support frame to the tractor as well as to enable vertical swinging. At the same time, ram 60 is so pivotally coupled as to enable a different vertical swinging movement about another horizontal axis. That is, the elevator linkage including arm 46 also is pivotally mounted so as to swing vertically. By reason of the pivotal interconnection to box scraper 80, the swinging of that linkage affords an additional degree of movement of box scraper 80.

In operation, the overall combination of all apparatus may be moved forwardly or rearwardly with box scraper 80 and roller 120 generally in a horizontal orientation as shown in FIG. 1. This mode of operation, in itself, is not unlike the conventional usage of a box scraper for terracing land to a level condition, with or without the addition of a roller. In an alternative mode, ram 60 is contracted so as to swing both box scraper 80 and roller 120 about pivotal coupling 52 and into an upwardly and forwardly inclined orientation. This manner of operation is particularly suitable for terracing slopes which slant downwardly toward the unit. On the other hand, extension of ram 60, as shown in FIG. 3, causes roller 120 and box scraper 80 to be tilted downwardly and forwardly so as to be capable of use in terracing a down slope ahead of tractor 20.

Each of the foregoing modes of operation could be accomplished with pivotal coupling 52 being fixed in position in relationship to the chassis of tractor 20. In the illustrated embodiment, however, the elevator linkage which includes arm 46 affords a significant additional degree of manipulation. As shown in FIG. 1, the elevator linkage preferably is in a nominally center or somewhat lower position of its degree of swinging movement. FIGS. 2 and 3 illustrate typical orientations for shaping or terracing somewhat gentle upward or downward slopes respectively. To accommodate terracing of an extremely sharp uphill slope, as illustrated in FIG. 11, ram 56 may be operated to elevate arm 46 while ram 60 is contracted fully to thus enable a much higher angle of orientation of box scraper 80 and its attendant roller 120. Conversely, operation of ram 56 to lower arm 46 and extension of ram 60 enables the downward and forward tilting of box scraper 80 and its roller 120 so as to assume a highly vertical downward orientation as shown in FIG. 12. This latter mode may be used, for example, to shape the side walls of rather deep and sharply inclined ditches. In this mode, ditch walls may be terraced that simply are too steep for operation of a bulldozer and which would take much more time when attempted to be accomplished by use of a backhoe.

Even when finally shaping substantially level ground areas, the degree of manipulation afforded by the combination of the actions affected by operation of rams 56 and 60 enables a rather sophisticated and highly desirable degree of control. By causing an increased downward movement of the elevator linkage, even to the extent of causing roller 120 to be raised above the ground upon which the work is being done, scraper blade 110 may be caused to cut deeply into the earth so as quickly to remove a high spot, for example. In some procedures, that downward force exerted by the elevator linkage or ram 60 is sufficient to cause lifting of front wheels 24 and 26 entirely free of the ground. A counterweight 180 lends a degree of balance for pivotal movement around the rear axles. That is, rear wheels 25 and 27 and roller 120 both establish pivot points about which the central or coupling portion of the combination may be raised to adjust cutting depth into a given contour or to vary compacting pressure. Moreover, this flexibility of orientation enables the operator to optimize approach angles as between cutting and terracing. At the same time, box scraper 80 has effectiveness in terracing earth when moved in either the forward or rearward directions. After a mound has been removed in the manner just mentioned, it often is necessary only to make one pass in a forward direction so as to smooth out the earth and then, preferably, to make one final pass to the rear so as to level and pack the loosened material.

While a particular embodiment of the invention has been shown and described, and various alternatives have been mentioned, it will be obvious to those skilled in the art that changes and modification may be made without departing from the invention in its broader aspects. Therefore, the aim in the appended claims is to cover all such changes and modifications as fall within the true spirit and scope of the invention.

I claim:

1. Earth working apparatus comprising:

a nominally horizontally-oriented rigid support frame;

a generally vertically-oriented elongated scraper blade, mounted laterally across a forward end of said support frame in a position for primarily working the earth, having a correspondingly laterally elongated cutting edge rigidly disposed below said support frame and with said blade and cutting edge oriented in a direction to cut and collect the earth when said frame is moved rearwardly;

a roller;

a bracket assembly for mounting said roller rigidly from and forwardly of said support frame with said roller disposed permanently during use in a fixed position axially parallel to said blade;

a steerable motive vehicle having powered front and rear wheels;

holding means disposed immediately at the rear of said support frame and pivotally coupled to said vehicle for enabling vertical swinging of said support frame about the axis of said roller;

means mounted on said vehicle and coupled in juxtaposition to said holding means for swinging said support frame about said axis;

ram means, disposed vertically above said holding means, pivotally coupled at one end to said support frame and at the other end to said vehicle, for effecting an additional vertical swinging of said support frame relative to said vehicle;

and said support frame including means defining a region, to the rear of said blade and continuing to said vehicle, which is free of structure positionable in the path of said blade during rearward movement of said frame.

2. Earth working comprising:

a nominally horizontally-oriented rigid support frame;

a generally vertically-oriented elongated scraper blade, mounted laterally across a forward end of said support frame in a position for primarily working the earth, having a correspondingly laterally elongated cutting edge rigidly disposed below said support frame and with said blade and cutting edge oriented in a direction to cut and collect the earth when said frame is moved rearwardly;

a roller;

a bracket assembly for mounting said roller rigidly from and forwardly of said support frame with said roller disposed permanently during use in a fixed position axially parallel to said blade;

a steerable motive vehicle having powered front and rear wheels;

holding means disposed immediately at the rear of said support frame and pivotally coupled to said vehicle for enabling vertical swinging of said support frame about the axis of said roller;

ram means, disposed vertically above said holding means, pivotally coupled at one end to said support frame and at the other end to said vehicle, for effecting vertical swinging of said support frame relative to said vehicle, an elevator linkage pivotally mounted on said vehicle to swing vertically;

means for pivotally coupling said holding means in juxtaposition to a swinging end of said elevator linkage;

power means for swinging said linkage;

and said support frame including means defining a region, to the rear of said blade and continuing to said vehicle, which is free of structure positionable in the path of said blade during rearward movement of said frame.

3. Earth working apparatus comprising:

a nominally horizontally-oriented rigid support frame;

a generally vertically-oriented elongated scraper blade, mounted laterally across a forward end of said support frame in a position for primarily working the earth, having a correspondingly laterally elongated cutting edge rigidly disposed below said support frame and with said blade and cutting edge oriented in a direction to cut and collect the earth when said frame is moved rearwardly;

a roller;

a bracket assembly for mounting said roller rigidly from and forwardly of said support frame with said roller disposed permanently during use in a fixed position axially parallel to said blade;

a steerable motive vehicle having powered front and rear wheels;

holding means disposed immediately at the rear of said support frame and pivotally coupled to said vehicle for enabling vertical swinging of said support frame about the axis of said roller;

ram means, disposed vertically above said holding means, pivotally coupled at one end to said support frame and at the other end to said vehicle, for effecting vertical swinging of said support frame relative to said vehicle;

an elevator linkage pivotally mounted on said vehicle to swing vertically;

means for pivotally coupling said holding means in juxtaposition to a swinging end of said elevator linkage;

power means for swinging said linkage;

means for pivotally coupling said ram means at said other end to said elevator linkage;

and said support frame including means defining a region, to the rear of said blade and continuing to said vehicle, which is free of structure positionable in the path of said blade during rearward movement of said frame.

4. Apparatus as defined in claims 1, 2 or 3 which further includes a generally vertically-oriented drag blade mounted laterally across said support frame forwardly of said scraper blade and in which said drag blade is hinged to said support frame to swing forwardly as said support frame is moved rearwardly.

5. Apparatus as defined in claims 1, 2 or 3 in which said front wheels are located between said rear wheels and said holding means, and in which the weight of said apparatus is sufficiently distributed and balanced to permit raising of said front wheels pivotally relative to said roller and to said rear wheels by actuation of said ram means.

6. Apparatus as defined in claim 4 in which, with said drag blade swung to its downward limit, the lowermost portion of said roller is spaced adjacent to but above a flat surface when both the lower margin of said scraper blade and the lower margin of said drag blade are resting thereupon.

7. Apparatus as defined in claim 4 in which said scraper blade defines a cutting edge facing said vehicle, in which said drag blade defines a cutting edge facing said roller, and which includes means for limiting downward swinging of said drag blade.

* * * * *